US010647122B2

(12) United States Patent
Ribeiro et al.

(10) Patent No.: US 10,647,122 B2
(45) Date of Patent: May 12, 2020

(54) METHOD AND DEVICE FOR MANAGING INK QUALITY IN AN INKJET PRINTER

(71) Applicant: Dover Europe Sàrl, Vernier (CH)

(72) Inventors: Joao Paulo Ribeiro, Guilherand Granges (FR); Jean-Pierre Arpin, Beaumont-Monteux (FR); Francis Pourtier, Charmes sur Rhone (FR)

(73) Assignee: DOVER EUROPE SÀRL, Vernier (CH)

( * ) Notice: Subject to any disclaimer, the term of this patent is extended or adjusted under 35 U.S.C. 154(b) by 430 days.

(21) Appl. No.: 15/165,340

(22) Filed: May 26, 2016

(65) Prior Publication Data

US 2016/0347074 A1 Dec. 1, 2016

(30) Foreign Application Priority Data

May 29, 2015 (FR) ..... 15 54892

(51) Int. Cl.
*B41J 2/175* (2006.01)
*B41J 2/045* (2006.01)
*B41J 2/195* (2006.01)

(52) U.S. Cl.
CPC ..... *B41J 2/175* (2013.01); *B41J 2/04571* (2013.01); *B41J 2/04586* (2013.01); *B41J 2/195* (2013.01)

(58) Field of Classification Search
CPC ..... B41J 2/04571; B41J 2/175
See application file for complete search history.

(56) References Cited

U.S. PATENT DOCUMENTS 4,580,143 A 4/1986 Larsen
5,160,939 A * 11/1992 Bajeux ..... B41J 2/125 347/6
5,459,497 A 10/1995 Manning
5,502,467 A 3/1996 Hoisington
6,003,965 A 12/1999 Arway
6,145,954 A 11/2000 Moore
(Continued)

FOREIGN PATENT DOCUMENTS

EP 0 362 101 A1 4/1990
EP 1 048 470 A1 11/2000
(Continued)

OTHER PUBLICATIONS

Search Report issued in French Patent Application FR 1554892 dated Apr. 6, 2016.
(Continued)

*Primary Examiner* — Henok D Legesse
(74) *Attorney, Agent, or Firm* — Pearne & Gordon LLP

(57) ABSTRACT

A method of calibrating an inkjet printer, which comprises a fluid circuit (4), a print head (1) connected to the fluid circuit through an umbilical (19), this method comprising at least the following functions: calculate a difference between the viscosity of the ink used in the circuit, and a theoretical viscosity of this ink; as a function of this difference, correct data representative of a characteristic function that relates the pressure at a point referred to as the reference point in the fluid circuit or the print head, the ink density, the ink viscosity, the operating temperature and a velocity referred to as the nominal velocity of the ink jet generated by the print head, to form corrected data for said characteristic function.

9 Claims, 7 Drawing Sheets

(56) References Cited

U.S. PATENT DOCUMENTS

| | | | | |
|---|---|---|---|---|
| 6,450,601 | B1 | 9/2002 | Pagnon | |
| 9,044,941 | B2 | 6/2015 | Odin | |
| 2002/0038611 | A1 | 4/2002 | Naniwa | |
| 2008/0100660 | A1 | 5/2008 | Perrin | |
| 2010/0079517 | A1 | 4/2010 | Akatsuka | |
| 2010/0245495 | A1* | 9/2010 | Katada | B41J 2/175 347/85 |
| 2012/0299989 | A1* | 11/2012 | Prothon | B41J 2/175 347/6 |
| 2012/0327145 | A1 | 12/2012 | Pouzet | |
| 2013/0076810 | A1* | 3/2013 | Shibata | B41J 2/175 347/6 |
| 2013/0208038 | A1* | 8/2013 | Isozaki | B41J 2/175 347/14 |
| 2016/0039216 | A1 | 2/2016 | Ribiero | |
| 2016/0052291 | A1 | 2/2016 | Pourtier | |
| 2016/0114590 | A1 | 4/2016 | Arpin | |

FOREIGN PATENT DOCUMENTS

| | | | |
|---|---|---|---|
| FR | 2618728 | A1 | 2/1989 |
| JP | 2001-071532 | A | 3/2001 |
| WO | 88/04235 | A1 | 6/1988 |
| WO | 97/09176 | A1 | 3/1997 |
| WO | 2011/012641 | A1 | 2/2011 |

OTHER PUBLICATIONS

Utility U.S. Appl. No. 15/088,190, Method and Device for Maintenance and Protection of a Hydraulic Connection, filed Apr. 1, 2016.

Utility U.S. Appl. No. 15/151,980, Method and Device for Partial Maintenance of a Hydraulic Circuit, filed May 11, 2016.

U.S. Appl. No. 61/301,723, Measuring System in a Fluid Circuit of a Continuous Inkjet Printer, Related Fluid Circuit and Block Designed to Implement Said Measuring System, filed Feb. 5, 2010.

Extended European Search Report for Patent Application No. EP 16 17 1770 dated Oct. 14, 2016.

* cited by examiner

METHOD AND DEVICE FOR MANAGING INK QUALITY IN AN INKJET PRINTER

TECHNICAL DOMAIN AND PRIOR ART

The invention relates to the field of printers, and particularly continuous inkjet (CIJ) type printers.

It also relates to the architecture (the layout of the Ink circuit) of a printer, for example of the CIJ type, and particularly to maintain an optimum quality of the ink.

Continuous inkjet (CIJ) printers are well known in the field of industrial coding and marking of miscellaneous products, for example for marking barcodes, Best Before dates on food products or references or distance marks on cables or pipes directly on the production line at high speed. This type of printer is also used in some decoration fields in which the possibilities of industrial graphic printing are used.

These printers have several typical subassemblies, as shown in FIG. 1.

Firstly, a print head 1, used usually offset from the body of the printer 3, is connected to it through a flexible umbilical 19 containing hydraulic and electrical connections necessary for operation of the head, while providing it with flexibility to facilitate integration on the production line.

The body of the printer 3 (also called the console or cabinet) usually contains three subassemblies:

- an ink circuit in the lower part of the console (zone 4'), that firstly supplies an appropriate quality of ink to the head at a stable pressure, and secondly handles ink output from jets that is not used for printing;
- a controller located in the top of the console (zone 5'), capable of managing sequences of actions and performing processing to activate different functions of the ink circuit and the head;
- an interface 6 that provides the operator with the means of using the printer and remaining informed about its operation.

In other words, the cabinet comprises 2 subassemblies: electronics, the electrical power supply and the operator interface at the top, and the ink circuit supplying nominal quality ink under pressure to the head and the negative pressure at which ink not used by the head is recovered, at the bottom.

Normally, the ink circuit comprises a reservoir called the main reservoir into which ink and solvent mix is brought. The ink and solvent originate from an ink cartridge and a solvent cartridge respectively. The main reservoir supplies the print head.

FIG. 2 diagrammatically shows a print head 1 of a CIJ printer. It comprises a drop generator 60 supplied with electrically conducting ink pressurised by the ink circuit (in zone 4').

This generator is capable of emitting at least one continuous jet through a small dimension orifice 60*a* called a nozzle. The jet is transformed into a regular succession of identically sized drops under the action of a periodic stimulation system (not shown) located upstream from the nozzle outlet. When the drops 7 are not used for printing, they are directed towards a gutter 62 that recovers them to recycle unused ink and return it into the ink circuit 4. Devices 61 placed along the jet (charge and deflection electrodes) can electrically charge the drops on command and deflect them in an electrical field Ed. They are then diverted from their natural ejection trajectory from the drop generator. The drops 9 intended for printing escape from the gutter and will be deposited on the support 8 to be printed.

This description can be applied to continuous ink jet (CIJ) printers said to be binary or multi-deflected continuous jet. Binary CIJ printers are provided with a head of which the drop generator has a large number of jets, and each drop from a jet can be oriented towards only 2 trajectories, either print or recovery. In multi-deflected continuous jet printers, each drop from a single jet (or from a few jets at intervals from each other) can be deflected on various trajectories corresponding to commands with different charges from one drop to another, thus scanning the zone to be printed along one direction called the deflection direction, the other scanning direction of the zone to be printed is covered by relative displacement of the print head and the support 8 to be printed. Elements are usually arranged such that these two directions are approximately perpendicular to each other.

An ink circuit of a continuous inkjet printer can firstly provide ink under regulated pressure, and possibly solvent, to the drop generator of the head 1 and can create a negative pressure to recover fluids returned from the head not used for printing.

It is also possible to manage consumables (distribution of ink and solvent from a reservoir) and to control and maintain the ink quality (viscosity/concentration), in particular to maintain the concentration.

Finally, other functions are related to the comfort of the user and automatic control over some maintenance operations so as to guarantee identical operation regardless of usage conditions. These functions include rinsing the head (drop generator, nozzle, gutter) with solvent, assistance with preventive maintenance such as the replacement of limited life components (filters, pumps).

These various functions have very different end purposes and technical requirements. They are activated and sequenced by the printer controller 5' that will become increasingly complex as the number and sophistication of the functions increase.

The use of inks containing pigments, for example titanium oxide ($TiO_2$ rutile or anatase), in the form of submicronic particles is particularly interesting, due to their whiteness and opaqueness. They are called pigment inks and are used for marking and identification of black or dark supports.

In general, an attempt is made to maintain an optimum ink quality, preferably under all usage conditions, to guarantee operation of the CIJ printer in the long term.

Maintaining this quality makes it possible to:

- guarantee ink stability, and to prevent or limit risks of sedimentation and consequently blocking;
- maintain the print contrast (due to the optical density of the ink);
- maintain a stimulation quality, in other words control breakage of the jet.

There is a system for slaving the concentration of pigments or colorants in the ink. But there is a need to improve the precision of slaving, by improving slaving means and calibration of this system.

This slaving system is calibrated on the printer production site. This calibration enables the measurement tool to be adjusted while taking account of the exact geometry of the printer (particularly the length and diameter of pipes).

This calibration has been made on printers for many years, and is done using a supposedly nominal ink.

In reality, ink is manufactured with a viscosity that may vary within a range of 10% depending on the ink (for manufacturing cost reasons), and existing systems do not take account of this variation.

An example of an ink quality management method in an inkjet printer is given in document EP 1048470. It is limited to a calibration phase when the machine starts and ignores the viscosity variations mentioned above.

Therefore, the problem arises of being able to have a system and a method that takes account of this observable viscosity variation between the theoretical viscosity of a given ink composition and the actual viscosity, observed after the ink has been manufactured with this composition.

The viscosity will also vary from one value to another during use of a printer. In other words, the viscosity will not be a stable parameter during the operating life of the printer.

This viscosity variation is due largely to three factors:

evaporation of the solvent, addition of solvent into the ink reservoir, which is the result of cleaning operations on all or part of the fluid circuit; these operations are made using solvent that is sent to the main reservoir after such operations;

temperature variations.

At the present time, there are different techniques for measuring the viscosity in printers, particularly CIJ type printers; the measurement of the ink viscosity can determine the ink quality. The different viscosity measurement techniques include:

gravitational viscosity measurement;

so-called "nozzle" viscosity measurement.

The latter technique can give a good measure of the ink quality used in the machine.

However, the jet has to be activated and a prior calibration has to have been made using ink from the first cartridge connected to the ink circuit.

However, the quality of ink produced in industrial quantity and then conditioned in cartridges does not have the so-called optimum quality, due to industrial tolerances. The result is that once calibrated, the printer will manage the ink quality around a quality level corresponding to the quality of the first cartridge and therefore not the same as the optimum quality. For pigment inks, such quality variations can be risky for correct operation of the printer.

Therefore, the question also arises of being able to correct a viscosity that has varied from a first optimum value to a second value, to restore it to said first value, because the entire printer is designed to operate with this first value.

Presentation of the Invention

The invention relates firstly to a method of calibrating an inkjet printer that comprises a fluid circuit, a print head connected to the fluid circuit through an umbilical, this method comprising at least the following steps:

calculate a difference between the viscosity of the ink used in the circuit, and a theoretical viscosity or a given a priori viscosity (or 1st viscosity) of this ink, as a function of this difference, correct data representative of a characteristic function, or of a $1^{st}$ characteristic reference curve, that relates the pressure, at a point referred to as the reference point, in the fluid circuit or the print head, the ink density, the ink viscosity, the operating temperature and a velocity referred to as the nominal velocity of the ink jet generated by the print head, to form corrected data for said characteristic function, thus possibly forming a 2nd characteristic reference curve.

Thus, the difference between an assumed or theoretical viscosity called the α priori viscosity of the ink, and the real viscosity of the ink actually used, is taken into account.

Thus, the printer is calibrated taking account of the real viscosity of the ink present in the printer. A measurement of this viscosity may be made when the ink is produced, with a precision as good as 0.1 cPs, under precise measurement conditions, particularly the temperature, and for a given jet velocity.

For example, the characteristic function relates firstly the pressure and secondly:

the dynamic pressure of the jet, the velocity of which is constant and conrolled;

regular pressure losses involving the ink viscosity;

pressure losses, or singular pressure losses, involving the density of the ink.

The pressure is preferably the pressure at the nozzle or it is representative of the pressure at the nozzle.

Preferably, the viscosity of ink used is stored in memory means associated with a cartridge that contains the ink used.

A method according to the invention may also include:

a measurement of an ink pressure in the fluid circuit at a temperature T, during production (by the print head) of an inkjet, at the nominal jet velocity, or at a velocity close to the nominal jet velocity, or at a velocity slaved to it;

a correction of data representative of said characteristic function, or of said $1^{st}$ or $2^{nd}$ characteristic reference curve, as a function of the difference between the measured pressure and a pressure obtained by said characteristic function or by said characteristic reference curve, for this temperature T.

The invention also relates to an operating method of an inkjet printer that comprises a fluid circuit, a print head connected to the fluid circuit through an umbilical, this method comprising at least the following steps:

performing a step to calibrate this inkjet printer, as disclosed above;

forming an inkjet, the jet having its velocity equal to or close to said nominal velocity, or slaved to this velocity, and a pressure at said reference point that is the result of corrected data obtained by the calibration method, or that is slaved to a pressure, at said reference point, that results from said corrected data.

Such a method may also comprise:

a measurement of a quantity representative of the viscosity of the ink used in the ink circuit, during formation of the ink jet;

the addition of a quantity of solvent into the ink when the viscosity is higher than a given reference value.

Advantageously, the quantity of solvent to be added depends on the dilution coefficient ($C_d$) of the ink.

The solvent may be added into a reservoir called the main reservoir, through a path usually used to add ink into said reservoir.

According to one advantageous embodiment, the quantity representative of the viscosity of the ink used in the ink circuit is the ink pressure at at least one point in the circuit.

This ink pressure may be measured in the ink circuit, downstream from an ink pressurisation pump (in this case and throughout the remaining disclosure, the term "downstream" should be understood as being along the direction of circulation of ink towards the print head).

Preferably, the measured pressure is representative of the pressure at the nozzle of the print head, through which the jet is formed.

More particularly, it may be measured in the ink circuit downstream from an anti-pulse device, itself located downstream from the ink pressurisation pump.

The invention also relates to a method of adjusting the ink viscosity in an inkjet printer which comprises a fluid circuit, a print head connected to the fluid circuit through an umbilical, the fluid circuit comprising at least one reservoir called the main reservoir and a pump to pump ink from this reservoir and send it to said print head, an anti-pulse device being located downstream from the pump, along the direction of circulation of ink towards the print head, a pressure sensor being located at the outlet from this anti-pulse device.

This method comprises at least:

- the formation of an inkjet, the jet having a velocity equal to or close to a predetermined velocity called the nominal velocity, or a velocity slaved to said nominal velocity;
- a measurement of the ink pressure or viscosity while the ink jet is flowing at said velocity, using at least one pressure measurement from the sensor;
- the addition of a quantity of solvent into the ink contained in the reservoir, when the viscosity is not equal to a given reference value.

Preferably, the solvent quantity to be added depends on the ink dilution coefficient ($C_d$).

This adjustment method may be combined with a prior calibration method according to the invention, as disclosed above or in this application.

In one example embodiment of a method according to the invention:

- if a pressure is measured, it is preferably equal to or is representative of the pressure at the nozzle of the print head through which the jet is formed; it is preferably measured at a point that can satisfy this condition;
- and/or when a jet is generated, it is generated at a velocity equal to or close to a predetermined velocity referred to as the nominal velocity, or at a velocity slaved to said nominal velocity.

The invention also relates to an inkjet printer comprising a fluid circuit, a print head connected to the fluid circuit through a flexible umbilical, the fluid circuit comprising at least one reservoir called the main reservoir, and a pump to pump ink from this reservoir and send it to said print head, an anti-pulse device being located downstream from the pump, along the direction of circulation of ink towards the print head, an ink pressure sensor being located at the outlet from this anti-pulse device.

This device may also comprise:

- means to store data representative of a characteristic function or of a characteristic reference curve, that relates the ink pressure, the ink density, the ink viscosity, the operating temperature and a velocity, called the nominal velocity, of an ink jet generated by the print head;
- means of adding a quantity of solvent into the ink contained in the reservoir, when the ink viscosity is different from a given reference value.

The invention also relates to a calibration device for an inkjet printer, to implement a method according to the invention.

Therefore, the invention also relates to a calibration device for an inkjet printer which comprises a fluid circuit, a print head connected to the fluid circuit through an umbilical, this device comprising:

- means of calculating a difference between the viscosity of the ink used in the circuit and a theoretical viscosity of this ink;
- means of storing data representative of a characteristic function, or of a $1^{st}$ characteristic reference curve, that relates the pressure at a point referred to as the reference point in the fluid circuit or the print head, the ink density, the ink viscosity, the operating temperature and a velocity called the nominal velocity, of the ink jet generated by the print head;
- means of correcting data representative of said characteristic function, as a function of said difference, thus forming corrected data of said characteristic function or data of a $2^{nd}$ characteristic reference curve.

This device can take account of a difference between an assumed or theoretical viscosity of the ink given a priori, and the actual viscosity of the ink actually used.

It can be used to calibrate the printer, taking account of the actual viscosity of the ink present in the printer.

As already explained above, the characteristic function or the characteristic reference curve may for example relate firstly the pressure and secondly:

- the dynamic pressure of the jet, the velocity of which is constant and controlled;
- regular pressure losses involving the ink viscosity;
- pressure losses, or singular pressure losses, involving the ink density.

The pressure is preferably the pressure at the nozzle or is representative of the pressure at the nozzle.

Such a device may also comprise:

- means of measuring an ink pressure in the fluid circuit at a temperature T, during generation of an ink jet by the print head, at nominal velocity;
- means of correcting data representative of said characteristic function, or of said $1^{st}$ or $2^{nd}$ characteristic reference curve, as a function of the difference between the measured pressure and a pressure obtained, for the same temperature T, by said characteristic function.

The invention also relates to an inkjet printer to implement a method according to the invention.

The invention also relates to an inkjet printer which comprises a fluid circuit, a print head connected to the fluid circuit through an umbilical, and a calibration device as disclosed above.

Such an inkjet printer may comprise an ink reservoir, a pump to pump ink from this reservoir and send it to said print head, an anti-pulse device being located downstream from the pump, a pressure sensor being located at the outlet from the anti-pulse device.

The invention also relates to an inkjet printer comprising a fluid circuit, a print head connected to the fluid circuit through an umbilical, the fluid circuit comprising a reservoir that can contain ink, a pump to supply the print head with ink drawn off from the reservoir, an anti-pulse device and a pressure sensor located at the outlet from this anti-pulse device.

Such an inkjet printer may also comprise means of adding a solvent quantity into the ink contained in the reservoir as a function of a pressure value measured by said sensor.

The means of adding a quantity of solvent into the ink contained in the reservoir may comprise means of adding ink (from a cartridge) into the reservoir. In other words, the solvent added in a device or method according to the invention may be added following a path through which the ink flows when it is added into the reservoir.

This printer may also comprise a calibration device as disclosed above.

A device or a printer according to the invention may also comprise means of slaving the velocity of a jet generated by the print head to the nominal velocity.

Preferably, a pressure sensor in a device or a printer according to the invention can be used to or is positioned to measure the pressure at the nozzle or a pressure representative of the pressure at the nozzle.

The invention also relates to an ink circuit in a continuous inkjet printer comprising at least one reservoir called the main reservoir, and means of controlling the printer, these means being adapted or programmed to implement a method according to the invention.

Electrical connection means supply electrical power to said print head.

The inkjet printer used in a method according to the invention or in a device according to the invention may be a continuous inkjet printer (CIJ) particularly of the binary type, or a multi-deflected continuous inkjet printer.

The invention also applies to any type of ink based on water or on any other component (ketone-, acetate- or ethanol-based inks, etc.).

DETAILED PRESENTATION OF AN EMBODIMENT

Figure 1:
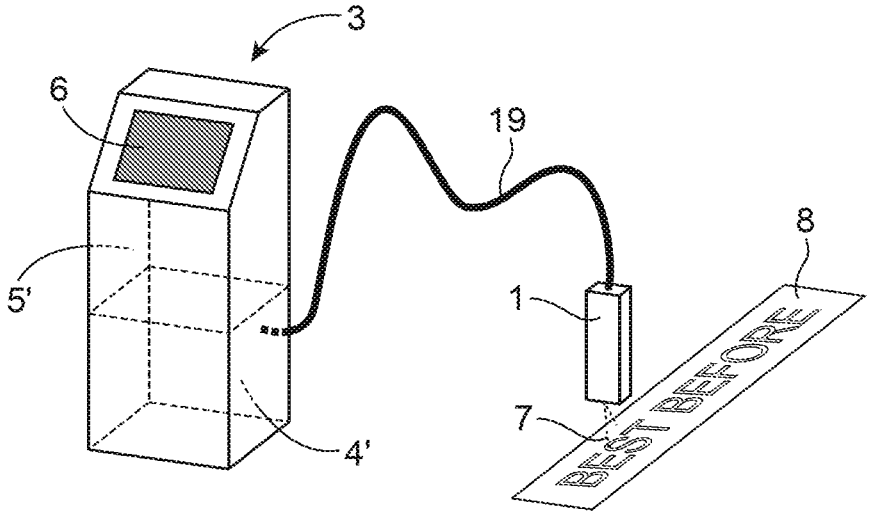
FIG. 1 shows a known printer structure.

An example of a method according to the invention will be given based on the description of a print machine disclosed above, with reference to FIGS. 1 and 2.

A characteristic curve C (or characteristic reference curve) is associated with each ink used in an inkjet printer, for example a continuous inkjet (CIJ) type printer, that gives the variation in pressure (for example at the nozzle outlet) as a function of the temperature, for the geometric characteristics of the printer nozzle and ink circuit and for a given jet velocity (for example 20 m/sec). A diagrammatic example of this curve C is given in FIG. 3.

More particularly, the pressure, for example at the nozzle, is equal to the sum of:

- the dynamic pressure of the jet (term 1) the velocity of which is constant and controlled;
- regular pressure losses (term 2) involving the ink viscosity;
- pressure losses, or singular pressure losses (term 3), involving the ink density.

Therefore, the pressure at the nozzle during the formation of drops can be written as follows and is the result of the sum of the three above-mentioned terms:

$$P_{nozzle} = \frac{1}{2}\rho(T)V_{jet}^2 + 32\frac{\mu(T)L_{nozzle}}{(2R_{nozzle})^2}V_{jet} + \frac{1}{2}K\rho(T)V_{jet}^2 \quad (1)$$

Where:

$\rho(T)$=ink density, expressed in kg/m$^3$;

$\mu(T)$=ink viscosity, expressed in Pa·s;

$L_{nozzle}$=nozzle length (or depth) expressed in m;

$R_{nozzle}$=nozzle radius, expressed in m;

K is a coefficient (singularity coefficient) characteristic of the ink circuit, and may be determined experimentally or adjusted during the calibration; it is unitless.

Note that if the pressure considered is not the pressure at the nozzle but is the pressure at a point at a distance from the nozzle, for example upstream from the umbilical 19, a similar formula would be obtained by adding a term relative to the level difference between the console 3 and the print head 1, to the above formula. The pressure continues to reflect the pressure at the nozzle or is representative of it.

Industrially, it is difficult to guarantee that the geometric and/or mechanical properties of a printer will be maintained. This is why a calibration is made for an ink circuit with a given structure to compensate for geometric and/or mechanical tolerances that vary from one ink circuit to another with the same structure; or it may be desirable over time to calibrate a machine that may already have been calibrated after the replacement of components (for example a part between the sensor and the nozzle) of the ink circuit, or a replacement of an electronic component of the controller.

This calibration makes it possible to make a correction that consists of repositioning the reference curve C by shifting it by a differential pressure equal to the difference between this curve C and a real operating point under reference conditions (nominal jet velocity defined during the design of the print head (particularly when determining the stimulation)) and taking account of the ink characteristics, for which curve C is given, and particularly a given concentration or viscosity. The real operating point is obtained by at least one pressure measurement in the ink circuit, for example at the nozzle or at another point in the circuit, for a given temperature and for the nominal jet velocity for which curve C is given. A pressure sensor is provided in the circuit for this purpose. The pressure measurement will give an image of the viscosity of the ink used that directly reflects the concentration (or more precisely the dilution rate) of the ink used. The concentration is controlled or slaved using the viscosity parameter that is the direct image of the ink quality.

The jet velocity may be kept constant at the nominal jet velocity, using a pump that sends ink from the main reservoir to the nozzle. The pump may form part of the slaving means comprising a jet velocity measurement sensor in the head, for example a sensor like that disclosed in application PCT/EP2010/060942.

Figure 3:
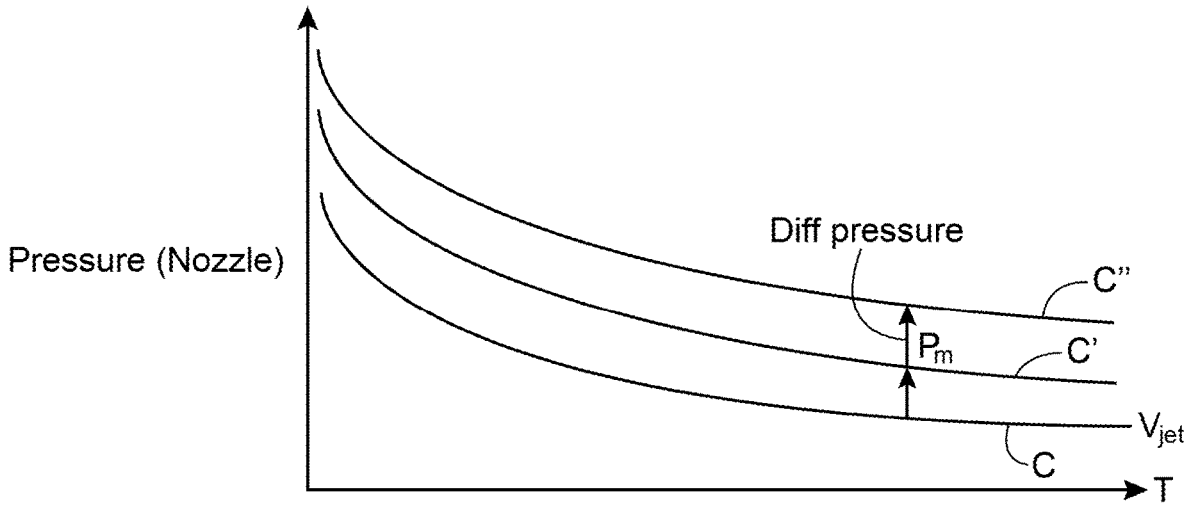
FIG. 3 is a diagrammatic view of a curve characteristic of an ink in an inkjet printer.

Thus, FIG. 3 shows a measurement point ($P_m$, T) that is the result of a pressure measurement at a point in the circuit, at a given temperature, for the selected ink and at the nominal jet velocity (for example 20 m/sec) for which curve C is given. At this temperature, curve C gives a value P. Therefore, a new curve C' can be obtained by translating the initial curve C by a value $P_m$−P. This difference is negative if the measurement point is located under curve C, and it is positive if the measurement point is located above curve C.

This correction is used to take account of variations or changes in geometric and/or mechanical parameters of the circuit.

It can also be seen that according to formula (1) above, the viscosity μ of ink makes a first order contribution to the 2nd term. Therefore the formula that is valid for a given viscosity (said to be the nominal or theoretical viscosity) will not be as valid when the real viscosity of the ink used is different from the nominal viscosity. There may be viscosity differences between different ink batches. In other words, the ink viscosity actually manufactured and used (visco_ink) may be different from said nominal viscosity of a «theoretical» ink with the same composition.

Therefore, it can be understood that curve C or even curve C', in FIG. 3 corresponds to this «theoretical» ink, and not to the ink actually produced and used.

Therefore, a correction can be applied that takes account of this shift in the real viscosity relative to the nominal viscosity, consisting of repositioning curve C (or C') by shifting it by a pressure difference proportional to the difference between the viscosity actually used (visco_ink) and the nominal viscosity visco_nominal (cP)−visco_prod (cP):

$$\text{Pressure_difference(mbars)}=A*(\text{visco_nominal}(cP)-\text{visco_prod}(cP))$$

In this formula, A is a proportionality coefficient.

If it is desired to take both of above two corrections into account, the curve C is shifted by a pressure difference that combines the 2 correction values:

$$\text{current pressure}-\text{reference pressure}+\text{Pressure_difference}.$$

A new curve C" is obtained, by translating the initial curve C by a value equal to this pressure difference.

Therefore, a calibration can be made that takes account of the real viscosity of the ink actually produced and used.

Therefore, according to the above teaching, a calibration method according to the invention can take account of the difference between the real viscosity of the ink used and the so-called theoretical viscosity that is the parameter normally used, for a given ink circuit, for a given ink and for a previously determined value of the jet velocity (for example 20 m/sec).

Preferably, such a method also takes account of the correction (equal to the difference current pressure−reference pressure) that takes account of variations of geometric and/or mechanical parameters of the circuit used.

Such a calibration can be made before print operations themselves begin, but concerning the correction that takes account of geometric and/or mechanical parameters, after having started the print machine and generating a jet at the selected constant velocity (nominal velocity).

Instructions for making at least one of the above calibration steps, are applied by the control means 3 (also called «controller»). In particular, these instructions will make it possible to circulate solvent in order to measure a pressure $P_m$, to store this measured value, to calculate the pressure difference $P_m$−P, and/or to calculate the pressure difference proportional to visco_nominal (cP)−visco_prod (cP).

For example, the control means 3 comprise a processor or a microprocessor or an electrical or electronical circuit, and are programmed to implement a method according to the invention. Preferably, these means control operation of the printer. They also store data, for example pressure measurement data (particularly from the pressure sensor) and/or data related to curve C (for example a set of pairs of (P, T) values associated with a nominal jet velocity) and/or data resulting from the correction(s) to data related to the curve, as explained above. The controller is also programmed to manage other operations, particularly actual print operations.

An example or a general structure of printer to which the invention can be applied is shown in FIG. 1, comprising a print head 1, which can be offset from the body of the printer 3 and connected to it through a flexible umbilical 19 containing hydraulic and electrical connections for operating the head, while providing it with flexibility to facilitate integration on the production line.

The body of the printer 3 (also called the console or cabinet) may contain three subassemblies:

- an ink circuit, for example located in the lower part of the console (zone 4'), that firstly supplies an appropriate quality of ink to the head at a stable pressure, and secondly handles ink output from jets that is not used for printing;
- a controller, for example located in the top of the console (zone 5'), capable of managing sequences of actions and performing processing to activate different functions of the ink circuit and the head;
- an interface 6 that provides the operator with the means of using the printer and remaining informed about its operation.

Normally, the ink circuit comprises a reservoir called the main reservoir into which ink and solvent mix is brought. The ink and solvent originate from an ink cartridge and a solvent cartridge respectively. The main reservoir supplies the print head.

Figure 2:
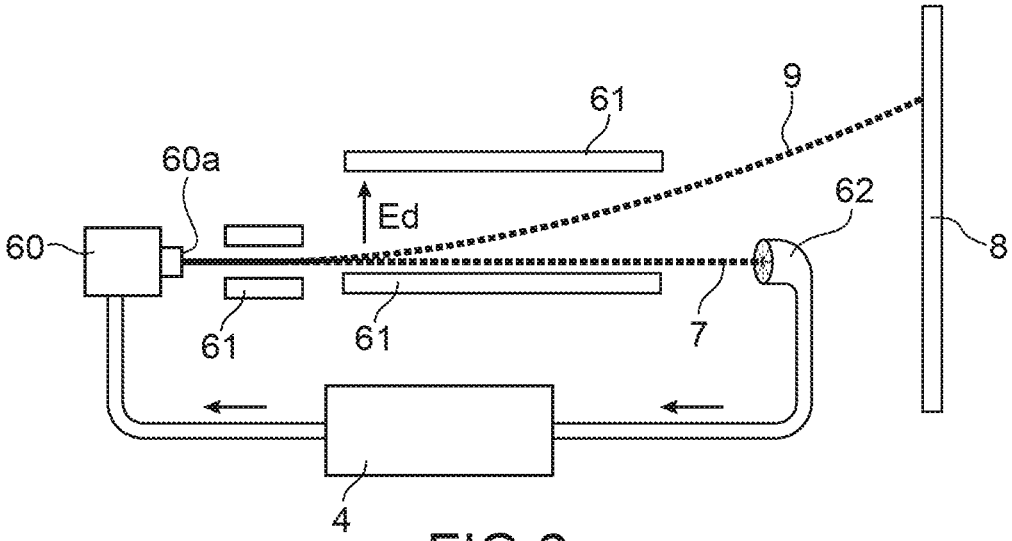
FIG. 2 shows a known structure of a print head of a CIJ type printer.

FIG. 2 diagrammatically shows a print head 1 of a CIJ printer which can be used in connection with the structure of FIG. 1. It comprises a drop generator 60 supplied with electrically conducting ink pressurised by the ink circuit (in zone 4').

Physical and/or chemical data related to the ink actually used, and particularly its viscosity (referred to above as «visco-ink»), may be stored in specific means associated with the ink cartridge used.

Figure 4:
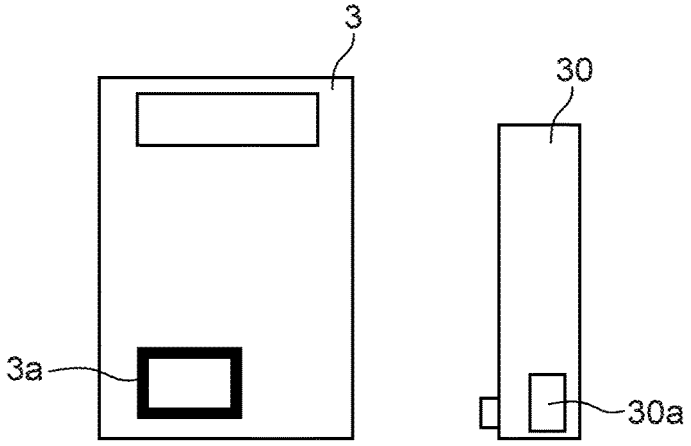
FIG. 4 shows an ink cartridge and means forming the controller of a printing machine.

This purpose is achieved as shown in FIG. 4, using a cartidge 30 provided with a circuit 30*a* (subsequently called a «tag»), for example made in the form of a processor or microprocessor. This circuit 30*a* may for example be applied in contact with a wall of the cartridge 30. This circuit stores data related to the actual viscosity of ink contained in the cartridge. As already disclosed above, there may be a difference between the so-called «reference» viscosity of an ink with a given composition and the actual viscosity of this ink when it is manufactured. Consequently, during manufacturing, this real viscosity may be measured and a corresponding data may be stored in means 30*a*.

This circuit 30*a* may also comprise communication means, for example an RFID type interface, that will dialog with the printer controller 3, for example to provide one or more data to it that will be interpreted as reflecting the presence of the cartridge and/or data related to the viscosity stored in means 30*a*.

The controller 3 is also provided with communication means 3*a*, for example an RFID type interface, so that data transmitted by the cartridge tag can be received.

As a variant, communication between the body 3 of the printer and the cartridge 30 may be of the contact type. In this case contacts are provided, firstly on the cartridge, and secondly on the printer, to be sure that data are transmitted between the cartridge 30 and the printer. Presence of the cartridge can be possibly detected, by sending an RFID signal from the tag to the controller, or by the controller reading the presence of the tag contacts. This verification may be done periodically.

A calibration like that mentioned above can be followed by printing by the printer, the ink jet being formed at a reference velocity or nominal velocity; the ink pressure can possibly be slaved to reach the pressure that preferably results from curve C".

An example of another method according to the invention will be given, once again based on the description of a print machine described above, with reference to FIGS. 1 and 2.

The viscosity of the ink used during use of such a machine changes.

Pressure variations occurring in the ink circuit of such a printer can be measured to measure variations of this viscosity. A pressure variation at a constant temperature and a constant jet velocity is essentially proportional to a variation in the viscosity, as explained above.

Therefore, it is possible to estimate pressure variations in the circuit at a given temperature and for a fixed jet velocity. A pressure sensor is provided for this purpose, preferably the same sensor as that used for calibration, as explained above if a calibration has already been made.

Such a pressure variation will be caused by, and will reflect, a variation in the viscosity.

If the machine has been calibrated, as explained above, a pressure difference between the value of the pressure sensor and the value given by the reference curve C' or C" is due to a difference in viscosity (or concentration) based on the following relation:

$$\boxed{\Delta P_{nozzle} = 32\frac{\Delta\mu(T)L_{nozzle}}{(2R_{nozzle})^2}V_{jet}^2} \quad (2)$$

When the pressure is no longer the pressure at the nozzle and instead is the pressure at another point in the circuit, additional viscous terms can be taken into account (for example resulting from the umbilical, etc.) but these terms are negligible compared with the difference in the pressure at the nozzle. This is the case particularly when the sensor is located on the jet line, particularly as explained below, downstream from an anti-pulse device. As long as the sensor remains on the jet line, additional pressure losses are low and are taken into account in the self-calibration from C to C'. On the other hand, a different position of the sensor on other lines of the circuit with a flow different from the flow of the jet would make the approach more complex.

This relation (2) can be used to measure the variation of the ink quality.

As a first approximation, the density does not vary much with the temperature and the jet velocity is continuously controlled, for example by means of pumping ink drawn off from the main reservoir (as mentioned above, the pump may form part of the slaving means comprising a measurement sensor for the jet velocity in the head, for example a sensor like that disclosed in application PCT/EP2010/060942).

A viscosity difference detected using the pressure sensor can subsequently be corrected by a volume of solvent to be added into the ink reservoir, to guarantee good ink quality or constant quality. This volume may be calculated taking account of the dilution coefficient that is specific to each ink and may be formulated as follows:

$$C_d=(\Delta\mu/\mu)/(\Delta V_r/V_r)$$

It represents the relative variation of viscosity resulting from a relative variation of the ink volume, that is itself the result for example of adding solvent.

The volume of solvent to be added may for example be determined from the following relation:

$$\Delta V(cc) = \frac{V_r(cc)}{C_d}\cdot\frac{100\cdot\Delta P_{corr}\cdot(\text{mbar})}{100\cdot P_{ref}\cdot(T,\text{ mbar}) - A(V_{jet})\cdot\rho_{ink}\ (\text{kg/m3})}$$

Where:

$A=(50/80)*(V_{jet})^2$;

$V_{jet}$=jet set velocity (m/sec);

$C_d$=dilution coefficient, specific to each ink, unitless;

$\rho_{ink}$=ink density, expressed in kg/m$^3$;

$P_{ref}$=reference pressure at the nozzle temperature, expressed in mbars;

$\Delta P_{corr}$=difference between the pressure and the reference pressure expressed in mbars;

$V_r$=ink volume in the circuit (reservoir and filter), expressed in cubic centimeters, that may for example be measured by means of measuring the level in the reservoir.

Added solvent may be measured by a level sensor in the solvent tank.

Therefore, it can be seen that the volume of solvent to be added takes account of the effects of dilution on the ink viscosity through the dilution coefficient.

Therefore a method of adjusting the ink viscosity according to the invention as disclosed above can include the following steps, for a selected ink and a predetermined value of the jet velocity (for example 20 m/sec):

measure a pair of values (pressure, temperature) for the ink used or measure a pressure of this ink for a given temperature;

compare this pair or this pressure with pairs of values (pressure, temperature), or with the reference pressure of this ink, assuming that it has a nominal reference viscosity; this or these reference value(s) may be the value(s) obtained by reading one of the curves in FIG. 3, particularly either curve C' or C" obtained by a calibration method like that disclosed above;

for an observed pressure difference between the measurement made and the reference pressure, correct the ink viscosity:

a) either by allowing solvent in the ink contained in the main reservoir to evaporate for a given time (this is the case in which the measured point is located below curve C" in FIG. 3);

b) or by adding solvent, in the case in which ink is more viscous (which is the case in which the measured point is located above curve C" in FIG. 3).

In the second case (b), the solvent volume added is preferably the volume calculated taking account of dilution or of the dilution coefficient, therefore this volume may be determined by the formula given above.

Such a method for adjusting the ink viscosity may also be made in the case of a change from a 1st viscosity value that is satisfactory (for example from the point of view of the print quality) to a 2nd viscosity value different from the 1st value, the method correcting this viscosity to this 1st value. This may be the case when for example no cleaning has been done. In this case, a pair of values (pressure, temperature) for the ink used is measured or a pressure of this ink used is measured for a given temperature and when the measured value represents a change from the $1^{st}$ viscosity value to the $2^{nd}$ viscosity value, the viscosity is corrected according to steps a) or b) above.

The $1^{st}$ value may be obtained by reading one of the curves in FIG. 3, particularly one of the curves C' or C" obtained by a calibration method like that disclosed above. Therefore, this adjustment method may be combined with a previous calibration method according to the invention.

Therefore during operation and particularly during printing, it is possible to measure the pressure at any time using a pressure sensor in the ink circuit, and use it to deduce an adjustment of the ink viscosity if necessary, for example by adding solvent according to the formula already given above.

The instructions to make a viscosity adjustment method like that disclosed above are used with control means 3. In particular, these are the means that will be used to calculate the pressure difference $\Delta P$ and that will give instructions to add solvent to the main reservoir, if necessary.

The control means 3 that for example comprise a processor or microprocessor or an electrical or electronical circuit, and are programmed to implement such a method. These are the means that control operation of the printer. They also store data, for example pressure measurement data (particularly from the pressure sensor), and possibly data related to one or several of the curves in FIG. 3. The controller is also programmed to manage other operations, particularly print operations.

An example or a general structure of printer to which the invention can be applied is shown in FIG. 1, comprising a print head 1, which can be offset from the body of the printer 3 and connected to it through a flexible umbilical 19 containing hydraulic and electrical connections for operating the head, while providing it with flexibility to facilitate integration on the production line.

The body of the printer 3 (also called the console or cabinet) may contain three subassemblies:

- an ink circuit, for example located in the lower part of the console (zone 4'), that firstly supplies an appropriate quality of ink to the head at a stable pressure, and secondly handles ink output from jets that is not used for printing;
- a controller, for example located in the top of the console (zone 5'), capable of managing sequences of actions and performing processing to activate different functions of the ink circuit and the head;
- an interface 6 that provides the operator with the means of using the printer and remaining informed about its operation.

Normally, the ink circuit comprises a reservoir called the main reservoir into which ink and solvent mix is brought. The ink and solvent originate from an ink cartridge and a solvent cartridge respectively. The main reservoir supplies the print head.

FIG. 2 diagrammatically shows a print head 1 of a CIJ printer which can be used in connection with the structure of FIG. 1. It comprises a drop generator 60 supplied with electrically conducting ink pressurised by the ink circuit (in zone 4'). In an inkjet printer, means 200 (or ink pressurisation circuit) are provided to draw off ink from the main reservoir, and to send it to the print head.

In particular, these means 200 comprise a pump that pumps ink from the main reservoir, that may then be directed towards the print head; this ink may possibly or alternately be directed to the ink cartridge itself, or to the main reservoir itself, instead of being sent to to the print head.

Figure 5:
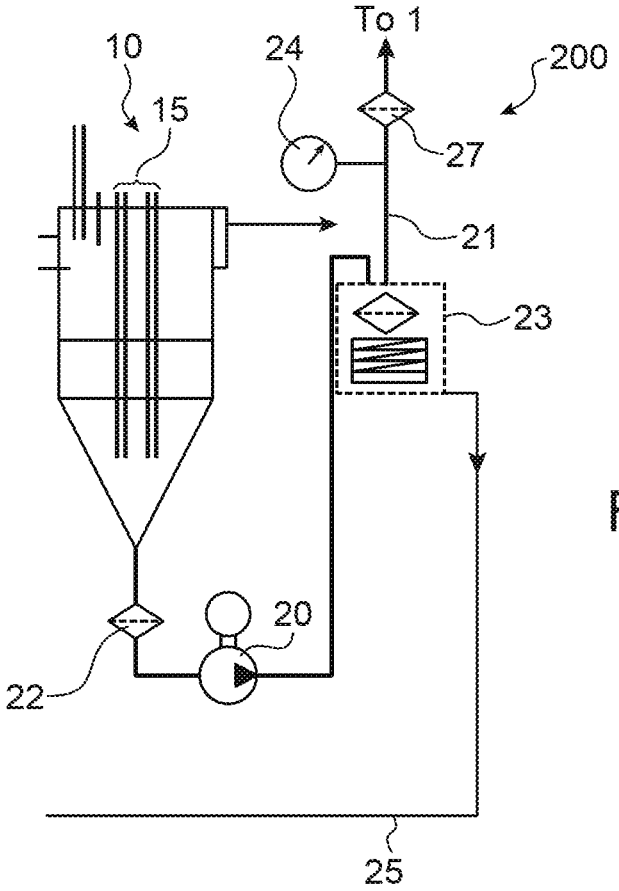
FIG. 5 is an example of a fluid circuit for pressurising ink according to this invention.

According to one embodiment shown in FIG. 5, the means 200 at the outlet from the main reservoir 10 comprise a filter 22, a pump 20 (called the ink pressurisation pump) and an anti-pulse device 23. The pump 20 will provide a constant jet velocity at the outlet from the print head nozzle, for example by forming part of the slaving means, comprising a sensor for measuring the jet velocity in the head, for example a sensor like that disclosed in application PCT/EP2010/060942.

Ink may be sent to the print head 1 through a conduit 21 connected downstream from the anti-pulse device 23. The print head may itself comprise a valve that enables or disables production of an ink jet and possibly a printout.

As a variant, ink may be sent through a conduit 25 (and a valve not shown in FIG. 5), either to the main reservoir itself or to the ink cartridge itself (as far as inside the ink cartridge). The ink path at the outlet from the pump 20 can be controlled using one or several valves, preferably a 3-way valves.

A pressure sensor 24 and possibly a temperature sensor is arranged as shown in FIG. 5, downstream from the anti-pulse device 23 and preferably at the outlet from the anti-pulse device and upstream from filter 27. Sensor 24 can be used to measure the ink pressure (or variations in this pressure) in the circuit. The data provided by this sensor can be used by the controller, particularly to slave the ink viscosity.

The position of a sensor 24 at the outlet from the device 23 compensates for pressure losses due to the device 23 and the remainder of the ink circuit that are difficult to model; thus, the measured pressure gives a good representation of the pressure at the nozzle.

This position of the sensor 24 can result in additional pressure losses that are low compared with the pressure at the nozzle and that are therefore taken into account in self-calibration (to shift from C to C'). On the other hand, another position of the sensor at another point in the circuit would make the approach more complex.

But this position downstream from or at the outlet from device 23 can also provide information about the pressure in the remainder of the circuit and particularly in means 300 that, as already explained above, can supply the main reservoir 10 with ink from the cartridge 30. Pressure information will be useful during other operating phases of the machine (for example shutdown phase and/or maintenance phase and/or self-diagnostic phase, during startup or shutdown), Therefore, the sensor 24 can give information during different phases of the machine, firstly when it is required to adjust the viscosity, and secondly during these other phases. For information, during these other phases, the position of the sensor 24 at the outlet from the device 23 is not optimum because the device 23 has a retarding effect on the ink, in other words the value measured by this sensor is not the value of the ink actually present at this instant in the remainder of the fluid circuit, upstream from the device 23. But this position makes it possible to use a single sensor for the 2 types of information.

All the means disclosed above with reference to FIG. 5, and particularly the pump 20 and the solenoid valve(s) used in combination with the means 200, are controlled by the controller 3 especially programmed for this purpose.

Figure 6:
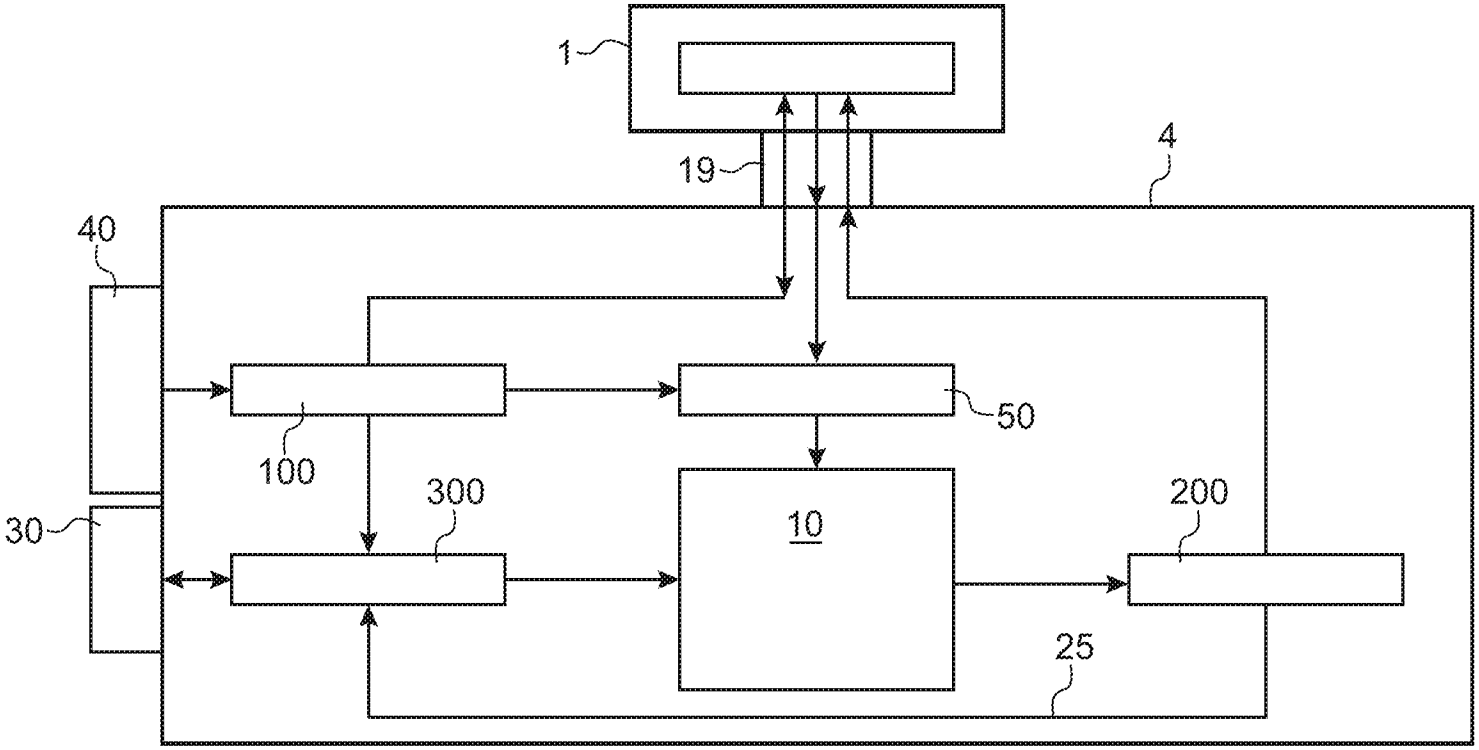
FIG. 6 shows an example of a fluid circuit to implement this invention.

An example of an architecture of the fluid circuit of a printer to which the invention can be applied is shown in FIG. 6 on which references identical to those used previously denote identical or corresponding elements. In particular, the flexible umbilical 19 is shown that contains hydraulic and electrical connections and the print head 1, to which the printer architecture disclosed below can be connected.

FIG. 6 shows that the fluid circuit 4 of the printer comprises a plurality of means 10, 50,100, 200, 300, each means being associated with a specific function. A removable ink cartridge 30 and a solvent cartridge 40 that is also removable are associated with this circuit 4. Although the presence of cartridges can be recommended, including when the ink circuit is stopped (for example to enable active monitoring), the ink circuit may be without the cartridges 30, 40 when stopped or at rest.

Reference 10 refers to the main reservoir that contains a mix of solvent and ink.

Reference 100 (or solvent supply circuit) refers to all means that are used to draw off and possibly store solvent from a solvent cartridge 40 and to supply solvent thus drawn off to other parts of the printer, either to supply the main reservoir 10 with solvent, or to clean or maintain one or several of the other parts of the machine.

Reference 200 denotes all means used to draw off ink from the main reservoir 10, an example of these means has been disclosed above with reference to FIG. 5. These means 200 (or ink pressurization circuit) are for pressurising ink drawn off from the main reservoir and for sending it to print head 1. According to one embodiment illustrated here by arrow 25, it is also possible that these means 200 can be used to send ink to the means 300, and then once again to the reservoir 10, which enables ink flow recirculation inside the circuit. This circuit 200 may also allow draining the reservoir in the cartridge 30 and/or cleaning of the connections of the cartridge 30 (in the case of the embodiment in FIG. 10, by changing the position of the valve 37).

Reference 300 (or ink supply circuit) refers to all means of drawing off ink from an ink cartridge 30 and supplying the ink thus drawn off to supply the main reservoir 10. As can be seen on this figure, according to the embodiment disclosed herein, these means 300 can be used to send solvent from means 100 to the main reservoir 10.

The system shown on this figure also comprises means 50 of recovering fluids (ink and/or solvent) that returns from the print head, more precisely from the gutter 62 of the print head or from the head rinsing circuit. Therefore these means 50 are arranged on the downstream side of the umbilical 19 (relative to the flow direction of fluids returning from the print head).

As can be seen on FIG. 6, the means 100 may also allow sending solvent directly to these means 50 without passing through the umbilical 19 or the print head 1 or the recovery gutter 62.

Preferably, the means 100 comprise at least three parallel solvent supplies, one to the head 1, the $2^{nd}$ to means 50 and the $3^{rd}$ to means 300.

Each of the means described above can be provided with means such as valves, preferably solenoid valves, for guiding the fluid concerned to the chosen destination. Thus, means 100 can be used to send solvent exclusively to head 1, or exclusively to means 50 or exclusively to means 300 (and in particular, through these means 300, to the main reservoir 10).

Therefore, the means 100 are used to do partial rinsing (that enables a saving of fluid (solvent) and time, but also to not prevent other parts of the printer from performing some tasks); or complete rinsing of the entire circuit can be done by sending solvent to all means forming part of the ink circuit. These means 100 can also possibly send solvent exclusively to the main reservoir 10, particularly in the case in which such addition of solvent is considered necessary after the detection of a viscosity variation, as explained above.

Each of the means 50,100, 200, 300 described above can be provided with a pump that is used to process the fluid concerned (the $1^{st}$ pump, $2^{nd}$ pump, $3^{rd}$ pump, $4^{th}$ pump respectively). These various pumps perform different functions (the functions of their corresponding means) and are therefore different from each other, although these different pumps may be of the same type or a similar type (in other words, none of these pumps performs 2 of these functions).

Figure 7:
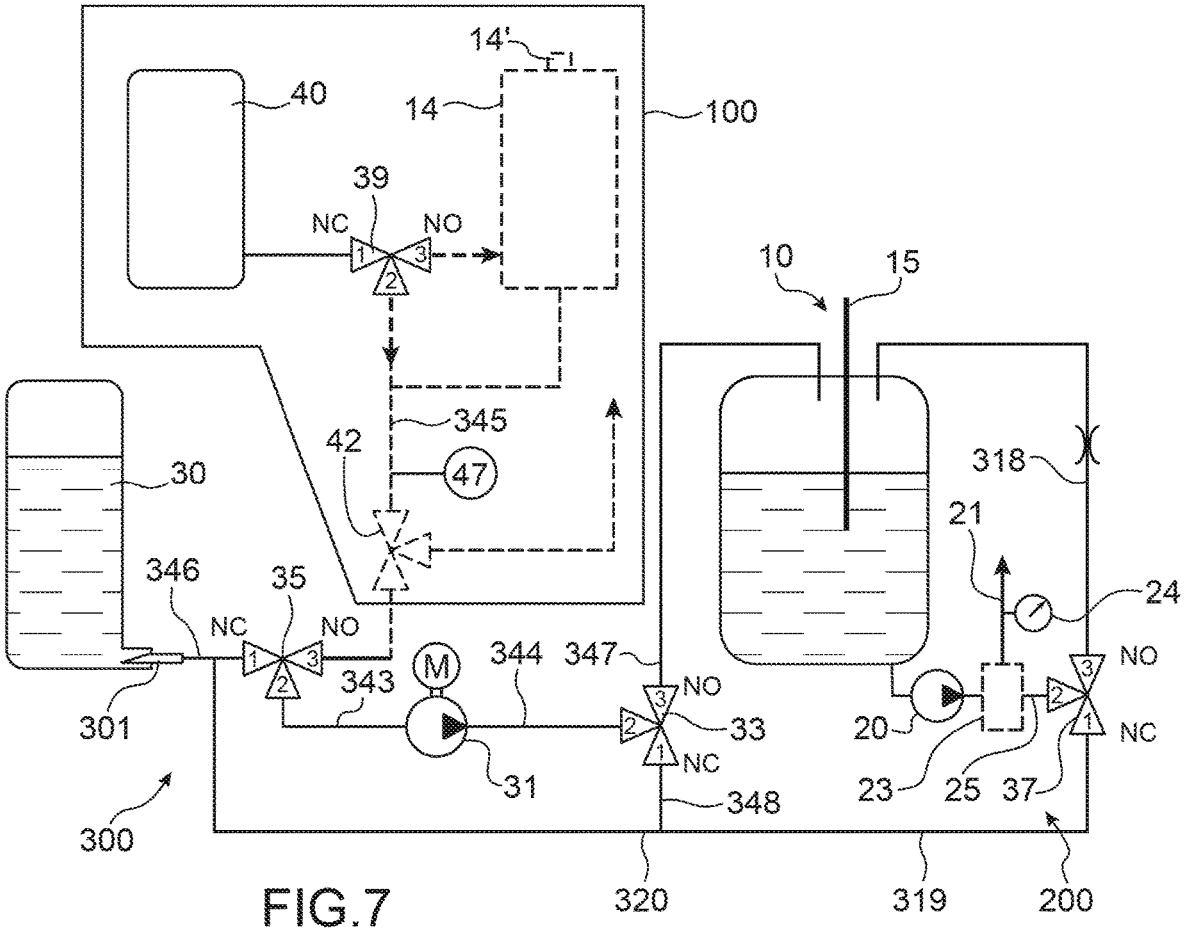
FIG. 7 is an example of an ink circuit, a main reservoir and a pressurisation circuit that can be used within the scope of this invention.

FIG. 7 shows a more detailed representation of means 300, in cooperation with the main reservoir 10 and the means 200.

The main reservoir 10 is preferably provided with means 15 for detecting the level of ink contained in it (in fact the ink in it is mixed with the solvent).

Reference 301 refers to the cannula (or any equivalent means), that will provide fluid connection between the cartridge 30 and the rest of the circuit.

When the cartridge 30 is in position and contains ink, ink may be pumped by pumping means 31 ($4^{th}$ pump) towards the main reservoir 10 through fluid connection means, comprising conduits 346, 343, 344, 347 and one or more valve(s) (or solenoid valves) 33, 35, that may be 3-way type valves. Thus, the ink transfer pump 31 pumps ink from the cartridge 30, and the ink passes in sequence through valves 35 and 33 (in positions «12», or "NC", and «23», or "NO" respectively in FIG. 7), and through conduits 343, 344, 347 to reach the main reservoir 10. The NO (respectively NC) state of the valve 35 corresponds to the position «23» (respectively «12») creating connections between conduits 345 and 343 (respectively 346 and 343).

Means 345, 35, for example a conduit and a valve respectively (when the valve is in position «32» (NO) in FIG. 7) at the inlet to means 300, can be used to receive solvent from means 100. The means 300 will then increase the pressure of this solvent to a relative pressure (<<gauge pressure») equal for example to between 0 and 5 bars or between 0 and 10 bars, in fluid connection means.

This solvent may be directed through the conduits 343, 344 depending on the open or closed state of the valves 35 and 33:

- to reservoir 10 (through the conduit 347, valve 35 in position «32» (NO), valve 33 in position «23» (NO)), to add solvent into the reservoir 10;
- to conduits 320 (through the conduit 348, valve 35 in position «32» (NO), valve 33 in position «21» (NC)). Since the valve 37 is in the NO position, solvent can then be directed to the cartridge 30 through conduits 344, 348 and 320.

Ink pumped by pump 20 of means 200, at the outlet from the main reservoir 10, can be directed either towards the main reservoir itself (through the return conduit 318) or towards the cartridge 30 itself (and into this cartridge) through one or several conduits 319, 320, The ink path at the outlet from the pump 20 may be controlled by means of one or several valves 37, preferably a 3-way valve. In FIG. 7, the position «21» («NC») of valve 37 directs the ink flow towards the conduit 319, and position «23» («NO») directs the ink flow towards the conduit 318. Ink is transferred to the print head 1 through a conduit 21 that collects ink downstream from the pump 20, preferably from means 23 located between the outlet from the pump 20 and the valve 37.

FIG. 7 also diagrammatically shows means 100 for supplying solvent from a removable cartridge 40 and possibly from an intermediate reservoir 14. The solvent may be drawn off using a pump not shown on this figure, from one or another of these reservoirs through a valve 39 and sent through the conduit 345 and possibly a valve 42, towards the valve 35 and means 300.

Generally, the instructions to activate pumps and valves are sent and controlled by the control means 3 (also called "controller"). In particular, these instructions will control flow of solvent, that can be under pressure, from means 100 to various other means 1, and/or 50, and/or 300 of the circuit (and possibly through these latter means 300 to the main reservoir 10).

The control means 3 may comprise a processor or microprocessor, programmed to implement a cleaning method according to the invention or one or several steps according to the invention. These means control the opening and the closing of each valve, as well as the activation of the pumping means, in order to circulate ink and/or solvent as disclosed in this application. In one or more memory or memory means, it also memorises data, for example pressure measurements datad (in particular from sensor 24) and/or ink and/or solvent level measurement data, and may also possibly process these data. The controller is also programmed to manage other operations, particularly printing operations. It also stores in said memory or memory means data related to the optimum viscosity of an ink or to a variation of this viscosity as a function of temperature.

For safety reasons, the controller may make sure that the cartridge is still in position before any fluid, in particular solvent, is transferred to the cartridge 30, for example during cleaning operations. No operation will take place if no cartridge is in position. As already described above, this can be done using data exchanged between the cartridge 30 provided with a circuit 30*a* («tag»), and the printer controller 3, particularly one or more data that can be interpreted as demonstrating the presence of the cartridge.

The controller 3 may also check the non-empty state of the cartridge 30 for example, before starting some or any cleaning operation, for example of the cannula 301. The empty state of the cartridge 30 may be detected particularly by variations in the ink level in the main reservoir 10 measured using means 15 and the controller 3. For example, this is the case if the variation of the ink level is less than a threshold value (for example 5/10 mm) for a predetermined duration (for example 20s), when the pump 31 is in operation to inject ink to the main reservoir 10. On the other hand, if the variation in the ink level during said predetermined duration is more than the threshold value, the cartridge 30 is not empty. If a cartridge is in position but is empty, the cleaning operations will not take place.

Figure 8:
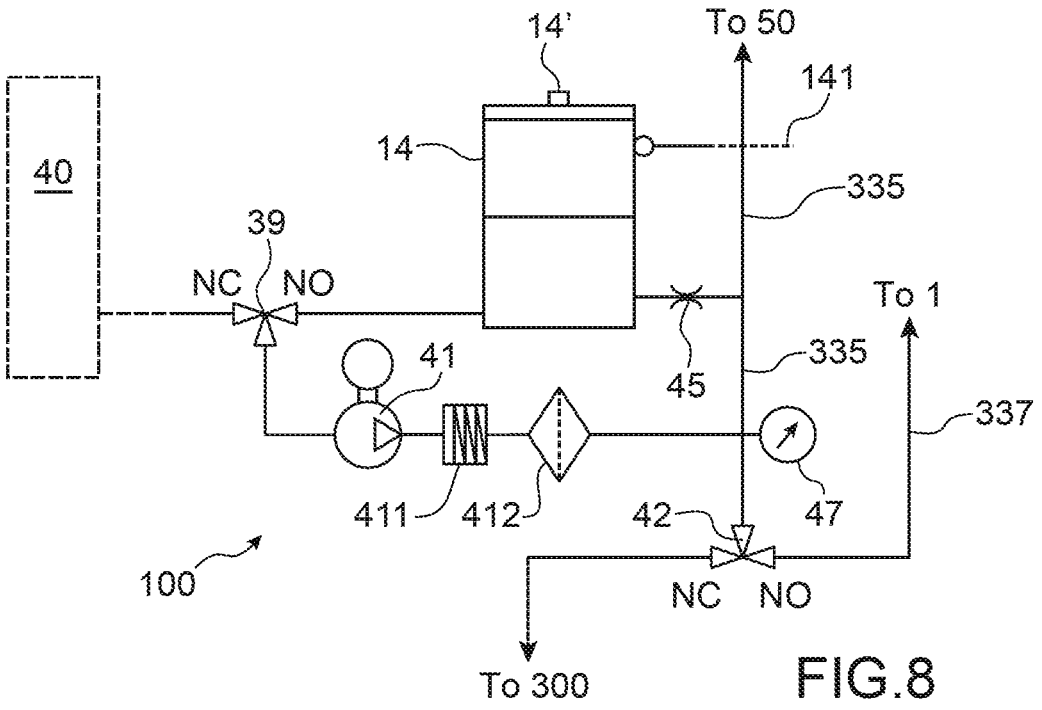
FIG. 8 is an example of a circuit for injecting solvent.

FIG. 8 shows an even more detailed representation of means 100 that draw off solvent from a cartridge 40 and send it to the different parts of the device, for example to perform cleaning or unblocking operations, or to supply solvent to the main reservoir 10.

These means comprise a pump 41 (the $2^{nd}$ pump) and various fluid connection means, each comprising one or several conduits or one or several valves 39, 42. One of these valves, the valve 42, guides solvent to 2 possible channels, namely the print head 1 or the ink supply circuit 300. In the latter case, when the means that enable solvent to enter means 300 are themselves closed, solvent is guided to means 50. An anti-pulsation device 411 and a filter 412 may also be arranged in series with the pump.

An intermediate reservoir 14 may also be provided that may be provided with level measurement means 14' and that may be supplied from a cartridge 40, when the cartridge is connected to the circuit.

Preferably, these means 14' comprise an ultrasound sensor that provides good precision for detection of the solvent level.

This reservoir 14 may send solvent to the various means 50, 300 and/or to the print head 1, to clean them or to unblock their hydraulic components; it may also supply solvent to the main reservoir 10. Solvent can also be drawn off from the cartridge 40 and sent directly to the various elements of the circuit, to perform the same operations (cleaning or unblocking or supply of the main reservoir 10). The source of the solvent is selected by a valve 39. The «normally open» (NO) and «normally closed» (NC) positions of each valve are shown on this figure, as on the others. In this case, if the valve 39 is in the «NC» position (FIG. 4), solvent is pumped from the cartridge 40, and if it is in the «NO» position, solvent is pumped from the reservoir 14.

The reservoir 14 may be supplied from the cartridge 40, for example through a calibrated leak or restriction 45 located at its inlet. This leak also participates in generating pressure. The reservoir 14 may be filled as follows; the valve 39 is in the «NC» position (see FIG. 8), so that solvent can be pumped from cartridge 40 through the pump 41. The valve 42 is in the closed (NC) position, while inlets to means 50 and 300 are prohibited to solvent.

Solvent can be sent to these various means 50 (through the conduit 335), 300, then possibly to the main reservoir 10, and/or to the print head 1 (through conduit 337) using valve 42 and means located at the inlet to means 50, 300, for example one inlet valve for each of these means. Therefore, 3 parallel channels are defined at the outlet from means 100 that, depending on the needs, will be used to send solvent to one and/or the other of these elements.

Means 100 may also comprise means 47 forming the pressure sensor, to measure the solvent pressure at the outlet from pump 41 and means 411, 412. This information can be used to detect a pressure increase in the solvent, which can be the result of a blockage in one of the conduits in which solvent flows.

The means 50 comprise a pump ($1^{st}$ pump) that pumps recovered fluid as described above, from the print head, and sends it to the main reservoir 10. This pump is dedicated to recovery of this fluid from the print head and is physically different from the $4^{th}$ pump of means 300 dedicated to transfer of the ink and/or from the $3^{rd}$ pump of means 200 dedicated to pressurisation of the ink at the outlet from reservoir 10.

Figure 9A:
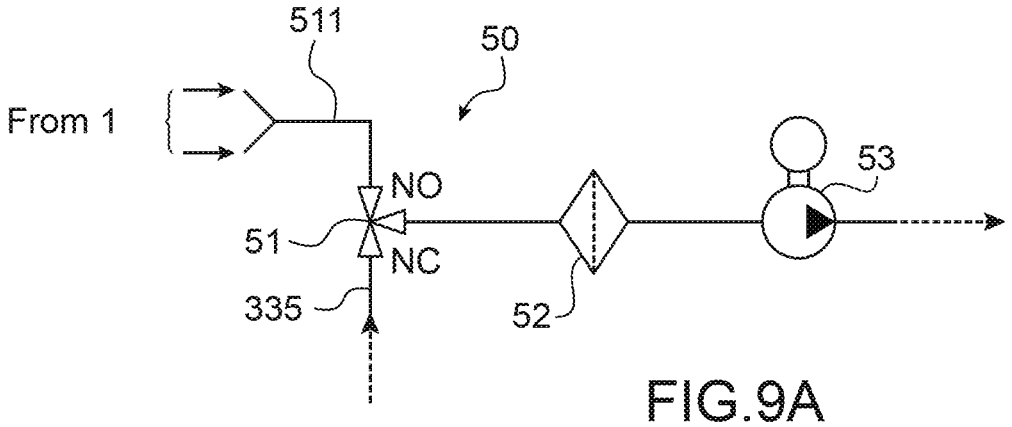
FIGS. 9A and 9B are examples of circuits for recovery from a fluid circuit.

FIG. 9A shows a more detailed representation of one embodiment of means 50 that allow recovery of fluids (ink and/or solvent) that returns from the print head. Therefore, two types of fluid can be brought together at the inlet to these means 50; ink from the recovery gutter 62 (see FIG. 2) and solvent that was used to clean or rinse the print head 1 and/or the umbilical 19. A conduit 511 guides these fluids to the inlet to means 50.

These means comprise a pump 53 (the $1^{st}$ pump), possibly a filter 52 arranged in series with this pump, for example upstream from the pump, and means 51 forming the inlet valve. These means 51 comprise one or several valves, preferably a three-way valve. They exclusively send fluid either from head 1 (NO position of the valve in FIG. 9A) through the conduit 511, or solvent from means 100 (NC position of the valve in FIG. 9A) through the conduit 335, to the pump 53.

Fluid pumped by the pump 53 can then be sent to the main reservoir 10.

Figure 9B:
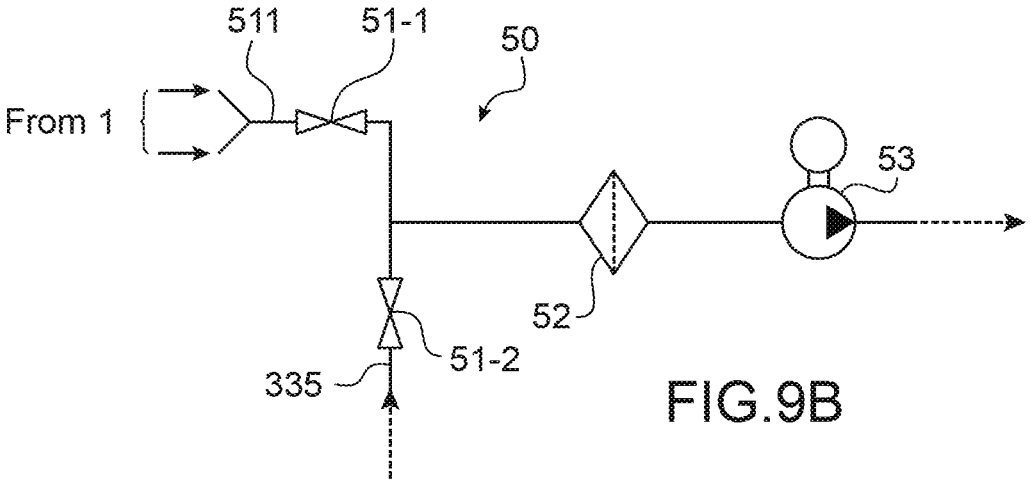

FIG. 9B shows a variant of FIG. 9A. On FIG. 9B, 2 valves 51-1 and 51-2 are implemented, instead of a three-way valve. Valve 51-1 is on conduit 511, and makes it possible to interrupt a flow of fluid returning from the print head 1; valve 51-2 is on a conduit through which clean solvent flows, and makes it possible to interrupt or block any flow of said clean solvent towards the pump 53. The other references on FIG. 9B are the same as on FIG. 5A and designate the same technical elements. Through the control of valves 51-1 and 51-2 (one of said valves being closed while the other one is open), this embodiment achieves the same result as with the one of FIG. 9A: fluid is exclusively sent either from head 1 (open position of valve 51-1 in FIG. 9B and closed position of valve 51-2) through the conduit 511, or solvent from means 100 (open position of the valve 51-2 in FIG. 9B and closed position of valve 51-1) through the conduit 335, to the pump 53.

Fluid pumped by the pump 53 can then be sent to the main reservoir 10.

One example operation of means 100 and 10 will be disclosed below.

Solvent is allowed into means 300, and is then pumped to the main reservoir 10. The solvent path is then the path normally used by ink (FIG. 7, path through conduits 343, 344, 347): valve 35 is changed from the NC state («12») to the NO state (channel «32») and pump 31 is activated to send cleaning solvent to the reservoir 10 (valve 33 being in the «NO» position). Therefore, solvent will supply the reservoir 10, so that in particular the composition of the ink contained in this reservoir can be adjusted.

This may be the case if it is decided to add solvent, in accordance with this invention.

Figure 10:
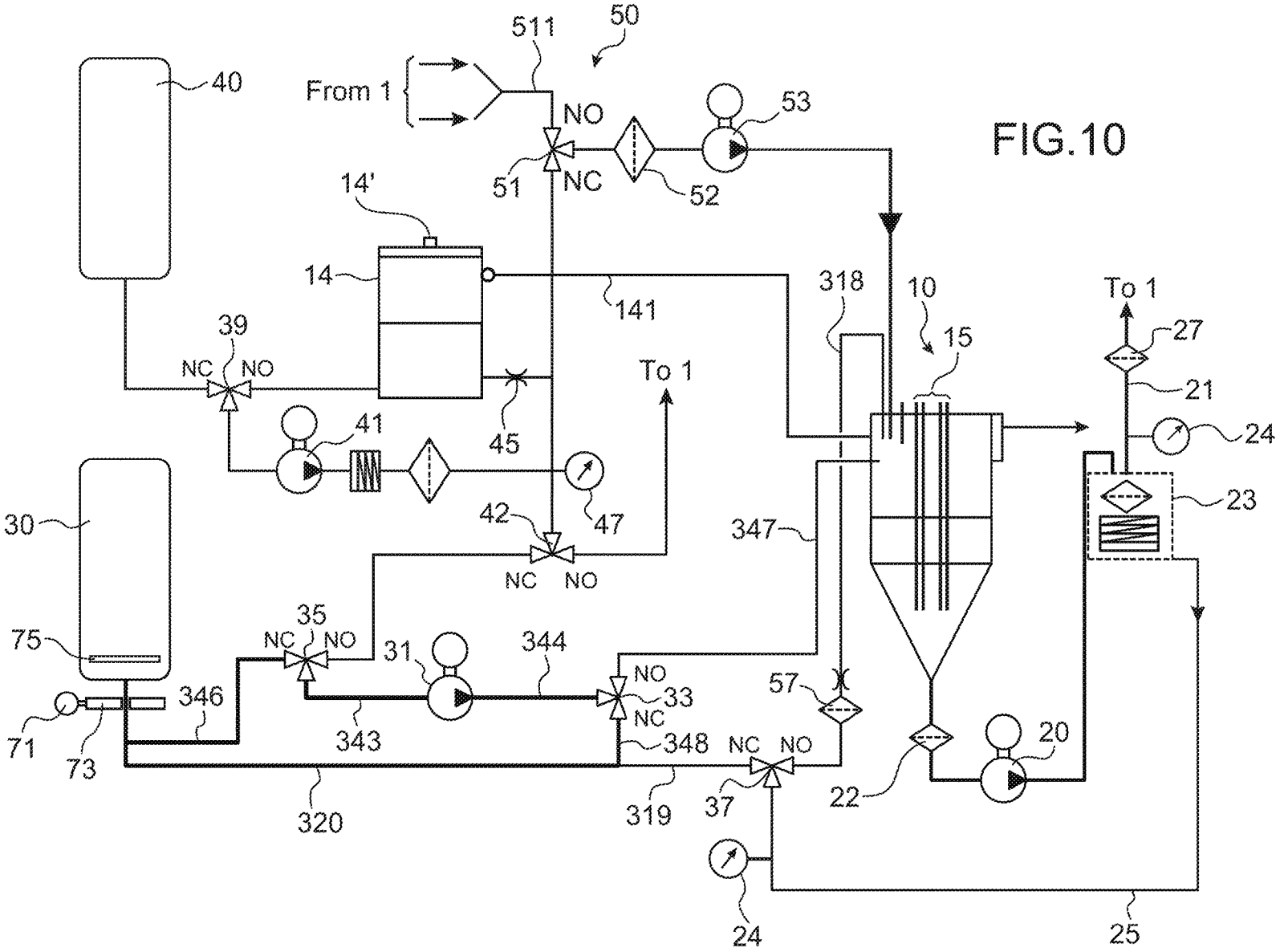
FIG. 10 shows an example of a fluid circuit structure according to this invention.

FIG. 10 shows an in ink circuit in which the circuit and the method described above, particularly with reference to FIGS. 3-9B, can be used. The different means 10, 50, 100, 200, 300 described above are combined. In this figure, numeric references identical to those in the previous figures refer to identical or corresponding elements.

The intermediate reservoir 14 has been described above. A conduit 141 can be used to bring the free volume located above each of the liquids contained in the reservoirs 10 and 14 to the same atmospheric pressure.

It should be noted that when the valve 42 is in the «NC» position while valve 35 is in the «NC» position, solvent flow is blocked both towards the cartridge 30 and towards the conduit 343; therefore, solvent is thus directed to valve 51 or to restriction 45 (and then enters the intermediate reservoir 14).

The invention is particularly useful for ink containing dense particle dispersions such as metals or metal oxide pigments, for example titanium, zinc, chromium, cobalt or Iron (such as $TiO_2$, ZnO, $Fe_2O_3$, $Fe_3O_4$, etc.) in the form of micronic or sub-micronic particles. Such a pigment ink can for example be based on $TiO_2$, and can be used for marking and identification of black or dark supports.

But it is also useful in the case of a non-pigment ink that can dry and form deposits of dry material in the conduits and connections of the ink circuit, as described above.

In the embodiments disclosed, a system can be provided for mixing ink from the cartridge, comprising:

a motor 71;

a magnet support 73.

A fastening screw can be used to fix the magnet support 73 onto the motor 71.

A magnetised bar 75 is inserted inside the ink cartridge 30. Interaction of these elements can rotate the magnet 75 inside the ink and thus stir ink in the cartridge.

The invention claimed is:

1. Method of calibrating an inkjet printer that comprises a fluid circuit, a print head connected to the fluid circuit through an umbilical, this method comprising:

measuring with a pressure sensor at a reference point in the fluid circuit or the print head, an ink pressure at a temperature T and at a nominal jet velocity;

correcting data representative of a theoretical characteristic reference curve that relates the pressure in the fluid circuit or the print head, the ink density, the ink viscosity, the operating temperature, and said nominal velocity of the ink jet generated by the print head, as a function of the difference between the measured ink pressure and a pressure resulting from said characteristic reference curve for said temperature T and said nominal jet velocity;

forming an actual characteristic reference curve based on the corrected data, thereby accounting for variations or changes in geometric or mechanical parameters of said fluid circuit, and forming an inkjet based on the actual characteristic reference curve.

2. Method according to claim 1, in which the viscosity of ink used is stored in a memory associated with a cartridge that contains the ink used.

3. Method according to claim 1, also comprising:

measuring an ink pressure in the fluid circuit at a temperature T, during production of an inkjet, at the nominal jet velocity, by the print head; and correcting the data representative of said theoretical characteristic reference curve, as a function of the difference between the measured pressure and a pressure obtained for the same temperature T.

4. Operating method of an inkjet printer that comprises a fluid circuit, a print head connected to the fluid circuit through an umbilical, the method comprising:

calibrating the inkjet printer according to claim 1, wherein the formed inkjet has a velocity equal to or close to said nominal velocity, and a pressure controlled to be equal to or close to the pressure at said reference point according to the actual characteristic reference curve.

5. Method according to claim 4, further comprising:

measuring a parameter representative of the viscosity of the ink used in the ink circuit at a temperature T, during formation of the ink jet;

adding a quantity of solvent into the ink when the viscosity is higher than a given reference value.

6. Method according to claim 5, in which the quantity of solvent to be added depends on the dilution coefficient (Cd) of the ink.

7. Method according to claim 5, in which the quantity representative of the viscosity of the ink used in the ink circuit is the ink pressure at at least one point in the circuit, or downstream from an ink pressurisation pump, along the direction of circulation of ink towards the print head, or downstream from an anti-pulse device itself located downstream from the ink pressurisation pump (20), along the direction of circulation of ink towards the print head.

8. Method according to claim 5, in which a quantity representative of the viscosity of the ink used in the ink circuit is a pressure of said ink, a quantity of solvent being added into the ink when the measured pressure of said ink is higher than a given reference value.

9. Method of operating an inkjet printer that comprises a fluid circuit, a print head connected to the fluid circuit through an umbilical, the method comprising:

calibrating the inkjet printer according to:

measuring with a pressure sensor at a reference point in the fluid circuit or the print head, an ink pressure at a temperature T and at a nominal jet velocity;

correcting data representative of a theoretical characteristic reference curve that relates the pressure in the fluid circuit or the print head, the ink density, the ink viscosity, the operating temperature, and said nominal velocity of the ink jet generated by the print head, as a function of the difference between the measured ink pressure and a pressure resulting from said characteristic reference curve for said temperature T and said nominal jet velocity;

forming an actual characteristic reference curve based on the corrected data, thereby accounting for variations or changes in geometric or mechanical parameters of said fluid circuit and forming an inkjet based on the actual characteristic reference curve, wherein the formed inkjet has a velocity equal to or close to said nominal velocity, and a pressure controlled to be equal to or close to the pressure at said reference point according to the actual characteristic reference curve, measuring a parameter representative of the viscosity of the ink used in the ink circuit at a temperature T, during formation of the ink jet; and adding a quantity of solvent into the ink when the viscosity is higher than a given reference value, in which a quantity representative of the viscosity of the ink used in the ink circuit is a pressure of said ink, a quantity of solvent being added into the ink when the measured pressure of said ink is higher than a given reference value, and in which the quantity of solvent to be added depends on the dilution coefficient (Cd) of the ink.

* * * * *